US010124571B2

(12) United States Patent
Ray et al.

(10) Patent No.: US 10,124,571 B2
(45) Date of Patent: Nov. 13, 2018

(54) ABLATION-TYPE LITHOGRAPHIC PRINTING MEMBERS HAVING IMPROVED EXPOSURE SENSITIVITY AND RELATED METHODS

(71) Applicants: Kevin Ray, Windham, NH (US); Travis Softic, Springfield, MA (US)

(72) Inventors: Kevin Ray, Windham, NH (US); Travis Softic, Springfield, MA (US)

(73) Assignee: PRESSTEK, LLC., Hudson, NH (US)

( * ) Notice: Subject to any disclaimer, the term of this patent is extended or adjusted under 35 U.S.C. 154(b) by 0 days.

(21) Appl. No.: 15/403,263

(22) Filed: Jan. 11, 2017

(65) Prior Publication Data

US 2017/0120658 A1 May 4, 2017

Related U.S. Application Data

(63) Continuation-in-part of application No. 15/246,762, filed on Aug. 25, 2016, now Pat. No. 9,827,759, which is a continuation-in-part of application No. 13/214,475, filed on Aug. 22, 2011, which is a (Continued)

(51) Int. Cl.

| | |
|---|---|
| ***B41C 1/10*** | (2006.01) |
| ***B41F 7/00*** | (2006.01) |
| *B41M 1/08* | (2006.01) |
| *B41N 1/00* | (2006.01) |

(52) U.S. Cl.

CPC ..... *B41F 7/00* (2013.01); *B41C 1/1033* (2013.01); *B41C 2201/02* (2013.01); *B41C 2210/262* (2013.01); *B41M 1/08* (2013.01); *B41N 1/003* (2013.01)

(58) Field of Classification Search

None

See application file for complete search history.

(56) References Cited

U.S. PATENT DOCUMENTS 5,339,737 A * 8/1994 Lewis ..... B41C 1/1033 101/454

6,096,476 A * 8/2000 Yanagida ..... B41C 1/1033 430/270.1

(Continued)

FOREIGN PATENT DOCUMENTS

DE 69620867 11/2002

EP 0580393 A2 1/1994

(Continued)

OTHER PUBLICATIONS

International Search Report and Written Opinion issued in a corresponding International Application No. PCT/US2018/012925 dated May 9, 2018.

*Primary Examiner* — Joshua D Zimmerman

(74) *Attorney, Agent, or Firm* — Morgan, Lewis & Bockius LLP

(57) ABSTRACT

Dry, ablation-type, nitrocellulose-containing lithographic printing members include dual adjacent imaging layers, both including an absorber and at least one containing a binder (which may include or consist essentially of a melamine resin). The absorber of the nitrocellulose-containing layer is a pigment and this layer contains no absorbing dye, while the absorber of the other imaging layer includes or consists essentially of a dye.

23 Claims, 1 Drawing Sheet

Related U.S. Application Data continuation-in-part of application No. 13/109,651, filed on May 17, 2011, now Pat. No. 8,967,043.

(56) References Cited

U.S. PATENT DOCUMENTS

| | | | | |
|---|---|---|---|---|
| 6,168,903 | B1 * | 1/2001 | Cassidy | B41C 1/1033 430/302 |
| 6,284,433 | B1 | 9/2001 | Ichikawa et al. | |
| 8,026,041 | B2 | 9/2011 | Melamed et al. | |
| 9,164,378 | B2 | 10/2015 | Iihara et al. | |
| 2012/0055363 | A1 | 3/2012 | Danzinger et al. | |
| 2012/0291645 | A1 * | 11/2012 | Rondon | B41C 1/1033 101/401.1 |

FOREIGN PATENT DOCUMENTS

| | | | |
|---|---|---|---|
| JP | H09131979 | | 5/1997 |
| WO | 9831550 | A1 | 7/1998 |
| WO | 2004011259 | A1 | 2/2004 |

* cited by examiner

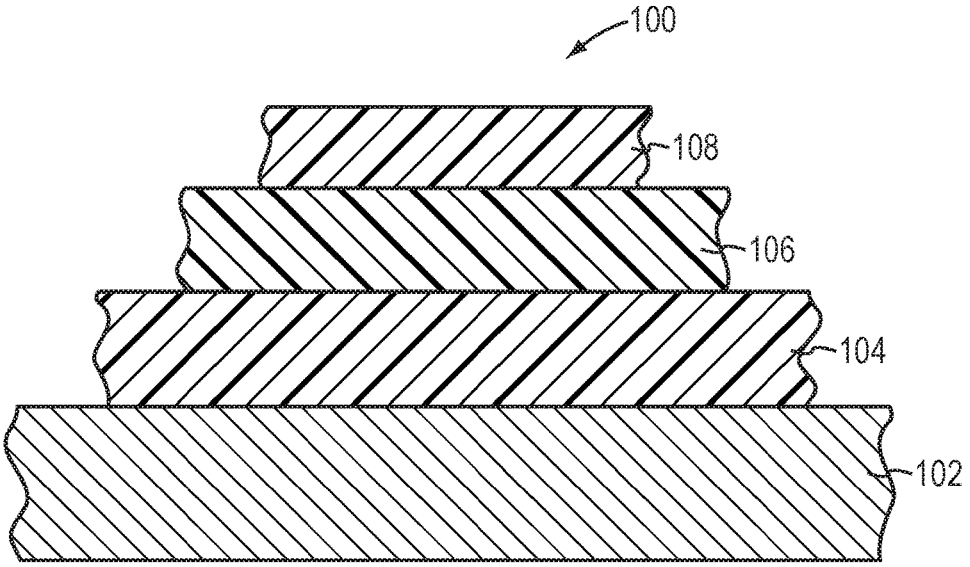
100
108
106
104
102

ABLATION-TYPE LITHOGRAPHIC PRINTING MEMBERS HAVING IMPROVED EXPOSURE SENSITIVITY AND RELATED METHODS

RELATED APPLICATION

This is a continuation-in-part of U.S. Ser. No. 15/246,762, filed on Aug. 25, 2016, which is a continuation-in-part of U.S. Ser. No. 13/214,475, filed on Aug. 22, 2011, which is itself a continuation-in-part of U.S. Ser. No. 13/109,651, now U.S. Pat. No. 8,967,043, the entire disclosures of both predecessor applications being incorporated herein by reference.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Current laser-based lithographic systems frequently rely on removal of an energy-absorbing layer from the lithographic plate to create an image. Exposure to laser radiation (typically in the near-infrared (IR) range) may, for example, cause ablation—i.e., catastrophic overheating—of the ablated layer in order to facilitate its removal. Because ablation produces airborne debris, ablation-type plates must be designed with imaging byproducts in mind; for example, the plate may be designed so as to trap ablation debris between layers, at least one of which is not removed until after imaging is complete.

Dry plates, which utilize an oleophobic topmost layer of fluoropolymer or, more commonly, silicone (polydiorganosiloxane), exhibit excellent debris-trapping properties because the topmost layer is tough and rubbery; ablation debris generated thereunder remains confined as the silicone or fluoropolymer does not itself ablate. Where imaged, the underlying layer is destroyed or de-anchored from the topmost layer. A common three-layer plate, for example, is made ready for press use by image-wise exposure to imaging (e.g., infrared or "IR") radiation that causes ablation of all or part of the central layer, leaving the topmost layer de-anchored in the exposed areas. Subsequently, the de-anchored overlying layer and the central layer are removed (at least partially) by a post-imaging cleaning process—e.g., rubbing of the plate with or without a cleaning liquid—to reveal the third layer (typically an oleophilic polymer, such as polyester).

The commercial viability of any printing system depends critically on the speed at which a printing plate can be imaged, and secondarily on the required laser power. These two parameters are intimately related, as higher laser power results in greater beam fluence, delivering a greater quantity of energy with each imaging pulse. Within limits, higher beam fluence levels increase the rate at which ablation takes place, so that imaging can be carried out at faster speeds—that is, each imaging pulse can be of shorter duration, so the plate can be imaged more quickly.

The relationship between laser power and imaging speed is not strictly inverse, however, and increasing laser power soon leads to diminishing returns, as the responsiveness of the plate imaging layer is constrained by physico-chemical characteristics that limit the rate at which ablation can take place. Moreover, high-power lasers are expensive both to procure and to operate, and can cause damage to the plate beyond the intended results of ablation. Accordingly, increases in imaging speed are desirably realized through improvements in plate characteristics. Nitrocellulose, for example, has long been used as a heat-sensitive ablation layer in printing plates owing to its ignitability—at high nitration levels it is an explosive and, indeed, was originally known as "guncotton"—and beneficial coating characteristics. Nitrocellulose can formulated to form crosslinked or uncrosslinked polymeric structures and can be applied using traditional coating techniques.

To convert imaging radiation into heat that will ignite the nitrocellulose, it is usually combined with a radiation absorber, e.g., in the case in infrared (IR) or near-IR imaging radiation, carbon black pigment or an IR-absorptive dye. The latter is often preferred for the high loading levels that can be achieved with concomitant reduction in minimum laser power. But the combination with nitrocellulose can lead to fabrication and stability challenges. Without being bound by any particular theory, it is believed that nitrocellulose retains its fluffy cotton-like conformation even when dissolved, and further, that this conformation is essential for performance during plate imaging. In the presence of an IR-absorbing dye, however, the nitrocellulose structure can collapse, impairing performance (the affected region does not absorb and respond to incident energy) and creating a telltale red spot, which leads to an unwanted void on the printed press sheet. The collapse is exacerbated by temperatures above 270° F. (making drying difficult) and can be substantially worsened by the presence of elemental metals such as copper, silver, or tin.

SUMMARY OF THE INVENTION

It has been found that the performance of nitrocellulose-containing lithographic printing members can be enhanced, and red-spot areas reduced or eliminated, through the use of dual adjacent imaging layers, both including an absorber and at least one containing a binder (which may include or consist essentially of a melamine resin). One of the imaging layers contains an IR-absorptive dye and no nitrocellulose, while the other layer contains nitrocellulose and an IR-absorptive pigment. By retaining the nitrocellulose in a separate (and desirably crosslinked) layer, the deleterious effects of the dye are avoided. Printing members in accordance herewith can therefore retain the benefits of using both an IR-absorbing dye (which can be loaded at high levels to reduce the minimum imaging fluence without impairing layer durability or coatability) and nitrocellulose (with its beneficial ablation characteristics) in substantial weight proportions—i.e., proportions that would be untenable in a single layer.

Accordingly, in a first aspect, the invention relates to a method of imaging a printing member. In various embodiments, the method comprises the steps of providing a printing member comprising (i) a subtrate having an oleophilic surface, (ii) first and second imaging layers disposed over the substrate, the first imaging layer comprising a binder and a near-IR absorber including a dye, the second imaging layer comprising nitrocellulose and a near-IR absorber that does not include a dye, and (iii) disposed over the imaging layers, an oleophobic third layer; (b) exposing the printing member to imaging radiation in an imagewise pattern, the imaging radiation at least partially ablating the imaging layers where exposed; and (c) cleaning the printing member to remove the third layer and at least a portion of the imaging layers where the printing member received imaging radiation, thereby creating an imagewise pattern on the printing member.

In another aspect, the invention pertains to a lithographic printing member. In various embodiments, the printing member comprises a substrate having an oleophilic surface; first and second imaging layers disposed over the substrate, wherein (i) the first imaging layer comprises a binder and a near-IR absorber including a dye, (ii) the second imaging layer comprises nitrocellulose and a near-IR absorber that does not include a dye, and (iii) the first and second imaging layers are at least partially ablatable by exposure to near-IR radiation at a fluence level no greater than 160 mJ/cm$^2$; and (c) disposed over the imaging layers, an oleophobic third layer.

In various embodiments of the method and/or the printing member, the first imaging layer has a first side in contact with the third layer and a second side, opposed to the first side, in contact with the second imaging layer, and the second imaging layer has a first side in contact with the first imaging layer and a second side, opposed to the first side, in contact with the substrate. The substrate may be a metal (e.g., aluminum) sheet having a grained surface in contact with one of the imaging layers. The binder of the first imaging layer may be a melamine resin.

In various embodiments, the second imaging layer further comprises a binder, e.g., a melamine resin. The nitrocellulose may have a nitration level above 10.7% but less than 12.3% by weight. In some embodiments, the the near-IR absorber of the first imaging layer further comprises carbon black. Alternatively, the near-IR absorber of the first imaging layer may consist or consist essentially of a dye. The near-IR absorber of the second imaging layer may consist or consist essentially of carbon black.

The cleaning fluid may be an aqueous liquid, e.g., plain tap water. In some embodiments, the aqueous liquid comprises water and a component that eases the removal of silicone. For example, the aqueous liquid may include not more than 20% (or not more than 15%) by weight of an organic solvent, e.g., an alcohol, and the alcohol may be a glycol (e.g., propylene glycol), benzyl alcohol and/or phenoxyethanol. The aqueous liquid may comprise a surfactant. It can be cold or, preferably, heated (usually up to 42° C./108° F., even 46° C./115° F.) or less than these temperatures. A typical chemical cleaning fluid is (by weight) diethylene glycol 60%, 2-(2-aminoethoxy)ethanol 10%, deionized water 29.75%, and SURFYNOL 104E surfactant 0.25% (although better results are typically obtained using tap water alone). The chemical cleaning fluid may also be heated.

As used herein, the term "plate" or "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement.

"Ablation" of a layer means either rapid phase transformation (e.g., vaporization) or catastrophic thermal overload, resulting in uniform layer decomposition. Typically, decomposition products are primarily gaseous. Optimal ablation involves substantially complete thermal decomposition (or pyrolysis) with limited melting or formation of solid decomposition products.

The terms "substantially" and "approximately" mean±10% (e.g., by weight or by volume), and in some embodiments, ±5%. The term "consists essentially of" means excluding other materials that contribute to function or structure. For example, a resin phase consisting essentially of a melamine resin and a resole resin may include other ingredients, such as a catalyst, that may perform important functions but do not constitute part of the polymer structure of the resin. Similarly, an imaging layer consisting essentially of a melamine (or other) resin and an IR absorber may contain other ingredients that do not contribute to ablation in response to imaging radiation; and an imaging layer consisting essentially of nitrocellulose and an IR-absorbing pigment may contain other ingredients that do not contribute to ablation in response to imaging radiation (i.e., it could not contain an IR-absorbing dye). A single crosslinked polymer network consisting essentially of, for example, melamine means that the melamine composition is the only crosslinked polymer network in the composition. Percentages refer to weight percentages unless otherwise indicated.

DESCRIPTION OF DRAWING

In the following description, various embodiments of the present invention are described with reference to the single FIGURE of the drawing, which shows an enlarged cross-sectional view of a printing member according to the invention.

DETAILED DESCRIPTION

1. Printing Plates

FIG. 1 illustrates a negative-working printing member 100 according to the present invention that includes a substrate 102, imaging layers 104 and 106, and a topmost layer 108. Layers 104, 106 are sensitive to imaging (generally IR) radiation as discussed below, and imaging of the printing member 100 (by exposure to IR radiation) results in imagewise full or partial ablation of the layers 104, 106. The resulting de-anchorage of topmost layer 108 facilitates its removal by rubbing or simply as a result of contact during the print "make ready" process. The ablation debris of layer 104 and/or layer 106 may be chemically compatible with water in the sense of being acted upon, and removed by, an aqueous liquid following imaging. Substrate 102 (or a layer thereover) exhibits a lithographic affinity opposite that of topmost layer 108. Consequently, ablation of layers 104, 106 followed by imagewise removal of the layer 108 to reveal an underlying layer or the substrate 102, results in a lithographic image. Even if layers 104, 106 are ablated only partially, they (and their ablation debris) are also ink-accepting, so their continued presence following imaging and cleaning does not adversely affect printing.

Most of the films used in the present invention are "continuous" in the sense that the underlying surface is completely covered with a uniform layer of the deposited material. Each of these layers and their functions is described in detail below.

1.1 Substrate 102

Substrate 102 provides dimensionally stable mechanical support to the printing member. The substrate should be strong, stable, and flexible. The topmost surface is generally oleophilic (and may also be hydrophilic). Suitable materials include, but are not limited to, polymers, metals and paper. As used herein, the term "substrate" refers generically to the ink-accepting layer beneath the radiation-sensitive layers 104, 106, although the substrate may, in fact, include multiple layers (e.g., an oleophilic film laminated to an optional metal support, such as an aluminum sheet having a thickness of at least 0.001 inch, or an oleophilic coating over an optional paper support).

The preferred substrate is a grained metal (e.g., aluminum) sheet, which is both oleophilic and hydrophilic (though the latter affinity is not relevant here). Traditionally, the use of a metal substrate 102 beneath a nitrocellulose imaging layer would require an intervening heat-insulating layer to prevent excessive heat dissipation and the consequent increase in minimum laser fluence. As described, however, in copending application Ser. No. 14/944,714, filed on Nov. 18, 2015 and hereby incorporated by reference, when heat-sensitive layers comprising an IR absorber and a crosslinked nitrocellulose composition are utilized in conjunction with roughened, anodized aluminum sheets, heat-insulating layers are superfluous and can be omitted from the plate without any deterioration in the waterless printing performance. Accordingly, metal substrates are preferably grained. The grained surface may be created by at least one of anodizing, electrograining or roughening with a fine abrasive. For example, the grained surface may be created by electrograining followed by anodizing.

In general, all aluminum sheet treatments usually employed for wet printing environment are suitable for consideration herewith. Any number of chemical or electrical techniques—in some cases, again, assisted by the use of fine abrasives to roughen the surface—may be employed. For example, electrograining involves immersion of two opposed aluminum plates (or one plate and a suitable counterelectrode) in an electrolytic cell and passing alternating current between them. The result of this process is a finely pitted surface topography that readily adsorbs water. See, e.g., U.S. Pat. No. 4,087,341. A structured or grained surface can also be produced by controlled oxidation, a process commonly called "anodizing." An anodized aluminum substrate consists of an unmodified base layer and a porous, "anodic" aluminum oxide coating thereover; this coating readily accepts water. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape—including, most importantly, water molecules. Anodizing and silicate treatment processes are described in U.S. Pat. Nos. 3,181,461 and 3,902,976. Poly(vinyl phosphonic acid) post-anodic treatment is desirable. Preferred substrate materials include aluminum that has been mechanically, chemically, and/or electrically grained with subsequent anodization. A silicate post-anodic treatment is preferred.

It is also possible to use an ungrained metal sheet with a primer layer thereover to reduce heat transmission and consequent dissipation, or a polymeric (e.g., polyester) substrate 102, e.g., coated with a primer layer to enhance adhesion.

1.2 Imaging Layer 104

Layer 104 contains nitrocellulose and is responsive to imaging radiation, typically near-IR radiation. Optionally, layer 104 has a cured resin phase consisting essentially of a melamine resin and, if desired, a resole resin, the latter being present in an amount ranging from 0% to 28% by weight of dry film. If a binder resin is included, the nitrocellulose is present in proportions similar to those of the resin phase. Preferably, the nitrocellulose has a moderate viscosity in solution, and furthermore, since it has hydroxyl groups in the molecule, it is especially likely to form a crosslinked structure. Nitrocellulose of any molecular weight suitable to the application, given the considerations described herein, may be employed. It is preferable that the nitrocellulose is not an explosive grade (less than 12.5% nitration), but instead in the range suitable for industrial use (more than 10.7% but less than 12.3% nitration). A near-IR absorber—typically a pigment such as carbon black—may be dispersed within the cured layer 104. Carbon black may be present, for example, in the range of 1 to 8%, especially 1.5 to 5%.

Suitable melamine resins include methylated, low-methylol, high-imino melamine materials. For example CYMEL crosslinkers from Cytek Industries, Inc., especially CYMEL 385, CYMEL 303, CYMEL 328, CYMEL 327, CYMEL 325 and CYMEL 323, may be employed. Melamine crosslinking may be facilitated by a sulfonic acid catalyst, typically a p-toluenesulfonic acid catalyst. When a melamine resin is used as the optional binder, layer 104 is a crosslinked layer. In such embodiments, layer 104 preferably comprises 20 to 60%, and especially 25 to 50%, nitrocellulose and 25 to 55%, especially 35 to 50%, CYMEL.

1.3 Imaging Layer 106

Layer 106 is a cured polymeric layer that includes an IR-absorbing dye, typically at high loading levels, and generally does not contain nitrocellulose or IR-absorbing pigment. Layers 104, 106 are in direct contact. Layer 106 can be any polymer capable of stably retaining, at the applied thickness, the IR-absorptive dye adequate to cause ablation of the layer in response to an imaging pulse. The melamine resins described in connection with layer 104 are suitable. For example, layer 106 may comprise 25 to 55%, and especially 35 to 50%, CYMEL and 30 to 60%, especially 35 to 55%, IR-absorbing dye. Carbon black may also be present, for example, in the range of 1 to 10%, especially 1 to 5%.

Typical drying temperatures for layers 104 and 106 are in the range from 270 to 290° F. (132 to 144° C.) with residence times from 35 to 45 seconds. Typical dry coat weights for layers 104 and 106 are $1.1 \pm 0.2$ g/m$^2$.

Desirably, layers 104, 106 both exhibit water compatibility following ablation. Furthermore, in embodiments where either or both layers are only partially ablated, they are either (a) sufficiently water-compatible to be fully removed during cleaning, or (b) oleophilic if some of layer(s) remain even after cleaning. It is found that carbon black enhances, or even confers, the desired water compatibility of layer 104 or the ablation debris thereof. Layers 104, 106 should exhibit good adhesion to adjacent layers, and resistance to age-related degradation may also be considered.

In various embodiments, ablatability is achieved at a fluence of 230 mJ/cm$^2$ or less, and more preferably at a fluence of 160 or 150 mJ/cm$^2$ or less. The ablation threshold is dictated primarily by layer thickness and the loading level and efficiency of the absorber.

1.4 Silicone Layer 108

The topmost layer participates in printing and provides the requisite lithographic affinity difference with respect to substrate 102; in particular, layer 108 is oleophobic and suitable for dry printing. In addition, the topmost layer 108 may help to control the imaging process by modifying the heat dissipation characteristics of the printing member at the air-imaging layer interface.

Typically, layer 108 is a silicone or fluoropolymer. Silicones are based on the repeating diorganosiloxane unit $(R_2SiO)_n$, where R is an organic radical or hydrogen and n denotes the number of units in the polymer chain. Fluorosilicone polymers are a particular type of silicone polymer wherein at least a portion of the R groups contain one or more fluorine atoms. The physical properties of a particular silicone polymer depend upon the length of its polymer chain, the nature of its R groups, and the terminal groups on the end of its polymer chain. Any suitable silicone polymer known in the art may be incorporated into or used for the surface layer. Silicone polymers are typically prepared by cross-linking (or "curing") diorganosiloxane units to form polymer chains. The resulting silicone polymers can be linear or branched. A number of curing techniques are well known in the art, including condensation curing, addition curing, moisture curing. In addition, silicone polymers can include one or more additives, such as adhesion modifiers, rheology modifiers, colorants, and radiation-absorbing pigments, for example. Other options include silicone acrylate monomers, i.e., modified silicone molecules that incorporate "free radical" reactive acrylate groups or "cationic acid" reactive epoxy groups along and/or at the ends of the silicone polymer backbone. These are cured by exposure to UV and electron radiation sources. This type of silicone polymer can also include additives such as adhesion promoters, acrylate diluents, and multifunctional acrylate monomer to promote abrasion resistance, for example.

The silicone layer may have a dry coating weight of, for example, 0.5 to 2.5 g/m$^2$, with the range 1 to 2.5 g/m$^2$ being particularly preferred for typical commercial applications.

2. Imaging of Printing Plates

Imaging of the printing member 100 may take place directly on a press, or on a platemaker. In general, the imaging apparatus will include at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. No. Re. 33,512 ("the '512 patent") and U.S. Pat. No. 5,385,092 ("the '092 patent"), the entire disclosures of which are hereby incorporated by reference. Lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image dots may be applied in an adjacent or in an overlapping fashion. The imaging apparatus can be configured as a flatbed recorder or as a drum recorder, with the lithographic plate blank mounted to the interior or exterior cylindrical surface of the drum.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate. In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Examples of useful imaging devices include models of the MAGNUS and TRENDSETTER imagesetters (available from Eastman Kodak Company) that utilize laser diodes emitting near-IR radiation at a wavelength of about 830 nm. Other suitable exposure units include the CRESCENT 42T Platesetter (operating at a wavelength of 1064 nm, available from Gerber Scientific, Chicago, Ill.) and the SCREEN PLATERITE 4300 series or 8600 series plate-setter (available from Screen, Chicago, Ill.).

Following imaging, and as described above, the printing member is subjected to an aqueous liquid to remove debris where the printing member received imaging radiation, thereby creating an imagewise pattern on the printing member.

In accordance with the present invention, machine cleaning takes advantage of the preferred imaging-layer coating weights. Preferred processing machines utilize warm water as a cleaning agent applied by spraying onto the plate (as opposed to immersion). Suitable examples include the KONINGS Plate Washer, type KP 650/860 S-CH (Konings GmbH, D-41751, Viersen, Germany) which has two rotary, oscillating brush rollers in the cleaning section), the AS-34 Plate Processor (NES Worldwide Inc., Westfield, Mass., which has three rotary, oscillating brush rollers in the cleaner section), and the PRESSTEK WPP85/SC850 Plate Washer (NES Worldwide Inc., which has two rotary brush rollers).

EXAMPLES

The following examples illustrate advantages of various embodiments of the present invention.

Example 1

The formulation below (for image layer 104), was applied to a prepared aluminum sheet (1052 aluminum alloy, electrochemically etched and anodized to give an anodic layer with Ra values in the order of 0.2-0.3 μm).

| Components | Parts by Weight Example 1 |
|---|---|
| Cymel 300 Resin | 2.38 |
| Micropigmo AMBK-8 | 2.00 |
| Lubrizol 2062 | 0.05 |
| Walsroder E 400 NC | 4.50 |
| Cycat 4040 | 0.88 |
| BYK 307 | 0.07 |
| Dowanol PM | 90.12 |

CYMEL 300 is a highly methylated, melamine resin supplied at 98% solids by Cytek Industries, Inc., Woodland Park, N.J. MICROPIGMO AMBK-8 is a pigment dispersion that is supplied at 18% solids by Orient Chemical, Osaka, Japan. CYCAT 4040 is a general purpose, p-toluenesulfonic acid catalyst supplied as a 40% solution in isopropanol by Cytek Industries, Inc. WALSRODER E 400 NC is a nitrocellulose damped with 30% IPA purchased from Dow Chemical, Midland, Mich. BYK 307 is a polyether modified polydimethylsiloxane surfactant supplied by BYK Chemie, Geretsried, Germany. DOWANOL PM, is propylene glycol methyl ether available from the Dow Chemical. LUBRIZOL 2062 is supplied by Lubrizol Corporation of Wickliffe, Ohio.

The formulation below (for image layer 106) was applied over the image layer 104.

| Components | Parts by Weight Example 1 |
|---|---|
| Cymel 300 Resin | 3.20 |
| Few Dye S 0094 | 4.50 |
| Lubrizol 2062 | 0.08 |
| Cycat 4040 | 1.00 |
| BYK 307 | 0.07 |
| nMP | 30.50 |
| Dowanol PM | 60.65 |

nMP is N-methyl-2-pyrrolidone, available from Dow Chemical. S0094 is a cyanine near IR dye manufactured by FEW Chemicals GmbH, Bitterfeld-Wolfen, Germany. The image layer 104 was applied to the aluminum substrate using a #7 wire-wound metering rod and then was dried and cured at 282° F. (temperature set on the oven dial) to produce a dried coat weight of 1.1 g/m$^2$. Drying and curing were carried out on a belt conveyor oven, SPC Mini EV 48/121, manufactured by Wisconsin Oven Corporation (East Troy, Wis.). The conveyor was operated at a speed of 3.2 feet/minute (which gives a dwell time of about 40 seconds in the air-heated zone of the oven). The image layer 106 was applied over the image layer 104 using a #6 wire-wound metering rod and then dried and cured at 282° F. to produce a dried coating weight of 1.1 g/m$^2$. The dwell time in the oven was the same as above.

The oleophobic silicone top layer 108 was subsequently disposed on the image layer 106 using the formulation given below. The silicone layer consists essentially of a highly crosslinked network structure produced via the addition or hydrosilylation reaction between the vinyl groups (SiVi) of vinyl-terminated functional silicone and the silyl (SiH) groups of trimethylsiloxy-terminated poly(hydrogen methyl siloxane) crosslinker, in the presence of a Pt catalyst complex and an inhibitor.

| Component | Parts by Weight Example 1 |
|---|---|
| PLY-3 7500P | 12.40 |
| DC Syl Off 7367 Crosslinker | 0.53 |
| CPC 072 Pt Catalyst | 0.17 |
| Heptane | 86.9 |

PLY-3 7500P is an end-terminated vinyl-functional silicone resin, with average molecular weight 62,700 g/mol, supplied by Nusil Silicone Technologies, Carpinteria, Calif. DC Syl Off 7367 is a trimethylsiloxy-terminated poly(hydrogen methylsiloxane) crosslinker manufactured by Dow Corning Silicones (Auburn, Mich.), which is supplied as a 100% solids solution containing about 30% of 1-ethynylcyclohexane which functions as catalyst inhibitor. CPC 072 is a 1,3 diethyenyl-1,1,3,3-tetramethyldisiloxane Pt complex catalyst manufactured by Umicore Precious Metals (Hoboken-Antwerp, Belgium), which is supplied as a 3% xylene solution.

The top layer solution was applied to the dried image layer 106 using a #15 wire-wound metering rod and was then dried and cured at 322° F. (temperature set on the oven dial) to produce a dry coating weight of 2.5 g/m$^2$. Drying and curing were also carried out on a belt conveyor oven at a speed of 3.2 feet/minute, which gives a dwell time of about 40 seconds.

Test

Example speed and print quality was assessed by means of a GTO press. Plates were imaged by power series using a custom GATF test target with power range of 88 to 230 mJ/cm$^2$, then put through a three-brush KONINGS processor, containing tap water to clean out imaged silicone. The plates were then mounted on press, press was set, impression on, and then sheets were collected.

Printed sheets assessed included sheets numbered 25, 50, 100 and sheet 200. The sheets were assessed based upon the energy dose required to achieve a solid 1-pixel area, the imaging speed required to achieve 2% dots, and the imaging speed required to achieve 1% dots (if they exist), within the 88 to 230 mJ/cm$^2$ range. In addition, a generally satisfactory reproduction of the image and its contrast was assessed.

Printing plate precursors were imaged on a Kodak Trendsetter image setter, operating at a wavelength of 830 nm, available from Eastman Kodak. A Heidelberg GTO 52 press, single color unit with automatic feed was used in the experiments. The ink used was Toyo King Aqualess Ultra Black MZUS as supplied by Toyo Ink, South Plainfield, N.J. The press blanket used was a Patriot 3000, 4 ply, 0.077 gauge as supplied by Day International (Flint Group Print Media North America, Arden, N.C.).

"Lab," as discussed below, is a measurement of coloration difference (or color or contrast in appearance) between imaged or exposed regions and the unimaged or non-exposed regions of a plate, as determined after imaging (and before development) using a conventional spectrophotometer (such as a MINOLTA CM508i) and the CIELAB system (Commission Internationale de l'Eclairage). No development is needed during this color measuring method. The CIELAB color system is described in detail in Principles of Color Technology, 2nd Ed., Billmeyer and Saltzman, John Wiley & Sons, 1981. In this color system, color space is defined in terms of L, a, and b wherein L is a measure of the chroma or brightness of a given color, a is a measure of the red-green contribution of a given color, and b is a measure of the yellow-blue contribution of a given color. Additional information is provided at http://en.wikipedia.org/wiki/Lab_color_space#CIE.sub.—1976.sub.—28L.2A-2C_a.2A.2C_b.2A.29_color_space.sub.—28CIELAB.29. Lab values were measured on plate unimaged areas and plate solid areas imaged at 230 mJ/cm$^2$. The difference was then calculated.

Finally, a visual assessment of red spots was completed. Without being bound by any particular theory or mechanism, it is believed that red spots are caused by undesirable interactions between IR dye and nitrocellulose, which creates an area that does not absorb energy. Red spots do not show up in the wet coating, only once that coating has been applied to a support or another layer and dried in an oven. These areas, if sufficiently large, become unimageable and will show up, undesirably, on the printed paper sheet.

Result

After 200 paper sheets were printed, the 1-pixel patch was fully solid at 159 mJ/cm$^2$, the 2% dots were strong at 88 mJ/cm$^2$ and the 1% dots were strong at 159 mJ/cm$^2$. Unimaged plate color is green, imaged areas are yellow-green at lower exposure doses and orange-green at higher image powers. No red spots were found on the plate. The L value difference is considered acceptable and leads to a plate design having a pleasing appearance and sufficient, usable color contrast.

| | L | a | b |
|---|---|---|---|
| Non-image area | 34.12 | −24.42 | 18.08 |
| Imaged area | 39.75 | −2.98 | 19.16 |
| Difference | 5.63 | 21.44 | 1.08 |

Example 2

In this example, the same aluminum substrate, image layer 104, and silicone layer as in Example is used, but a different image layer 106 is evaluated.

Image Layer 106:

| Components | Parts by Weight Example 2 |
|---|---|
| Cymel 300 Resin | 2.60 |
| Few Dye S 0094 | 3.96 |
| Lubrizol 2062 | 0.08 |
| Cycat 4040 | 0.85 |
| BYK 307 | 0.07 |
| Micropigmo AMBK-2 | 1.23 |
| nMP | 30.50 |
| Dowanol PM | 60.71 |

In this example, the optionally added carbon black helps improve plate color contrast. MICROPIGMO AMBK-2 is a pigment dispersion supplied at 20% solids. 50% of the solids is the carbon black material, while the remaining solids is a polyvinyl resin. AMBK-2 is supplied by Orient Chemical, Osaka, Japan.

Test

Samples were assessed as in Example 1.

Result

After 200 paper sheets were printed, assessment indicated the plate to have a slower response than Example 1. The 1-pixel patch was not fully formed even at 230 mJ/cm$^2$ and the 2% dots only showed at 195 mJ/cm$^2$. However, the plate still functions well and has a good contrast between image and non-imaged area (the L value difference is three times larger than control). No red spots were found on the plate sample.

| | L | a | b |
|---|---|---|---|
| Non-image area | 19.52 | −11.22 | 11.54 |
| Imaged area | 38.97 | −0.14 | 7.86 |
| Difference | 19.45 | 11.08 | 3.68 |

Example 3

This example uses alternative image layers 104, 106. The substrate and silicone layer are as set forth in Example 1.

Image Layer 104:

| Components | Parts by Weight Example 3 |
|---|---|
| Cymel 303 Resin | 2.84 |
| Micropigmo AMBK-8 | 4.00 |
| Lubrizol 2062 | 0.05 |
| Walsroder E 400 NC | 3.21 |
| Cycat 4040 | 0.88 |
| BYK 307 | 0.07 |
| Dowanol PM | 88.95 |

Cymel 303 is a highly methylated, melamine resin that is supplied at 98% solids by Cytek Industries, Inc.

Image Layer 106:

| Components | Parts by Weight Example 3 |
|---|---|
| Cymel 303 Resin | 3.70 |
| Few Dye S 0094 | 4.00 |
| Lubrizol 2062 | 0.08 |
| Cycat 4040 | 1.02 |
| BYK 307 | 0.07 |
| nMP | 30.50 |
| Dowanol PM | 60.63 |

Test

Samples were assessed as in Example 1.

Result

After 200 paper sheets were printed, the 1-pixel patch of the image was fully solid at 195 mJ/cm$^2$, the 2% dots fully formed at 106 mJ/cm$^2$. The plate contrast was also similar to Example 1 with an L value difference of 6.11 compared to 5.63 for Example 1. No red spots were found on the plate sample.

| | L | a | b |
|---|---|---|---|
| Non-image area | 28.37 | −12.17 | 9.30 |
| Imaged area | 34.48 | −2.57 | 11.02 |
| Difference | 6.11 | 9.6 | 1.72 |

Example 4

In this example, the same substrate, image layer 106, and silicone layer is used as in Example 2, but a different image layer 104 is used.

Image Layer 104:

| Components | Parts by Weight Example 4 |
|---|---|
| Cymel 300 Resin | 2.38 |
| Lubrizol 2062 | 0.05 |
| Walsroder E 400 NC | 4.50 |
| Cycat 4040 | 0.88 |
| BYK 307 | 0.07 |
| Black NC 60K330 | 0.64 |
| Dowanol PM | 91.48 |

Black NC 60K330 is a carbon black pigment and nitrocellulose blend, 31.6% solids as supplied by Pan Technology, Carlstadt, N.J.

Test

Samples were assessed as in Example 1.

Result

After 200 paper sheets were printed, the 1-pixel patch was fully solid at 212 mJ/cm$^2$, and the 2% dots fully formed at 106 mJ/cm$^2$. The plate contrast was stronger than the control, being dark green in the unimaged area and with an orange-green imaged area that gets darker in the highest exposed regions. No red spots were found in the plate sample.

| | L | a | b |
|---|---|---|---|
| Non-image area | 11.52 | −11.34 | 0.82 |
| Imaged area | 25.86 | −0.12 | 5.99 |
| Difference | 14.34 | 11.22 | 5.17 |

Comparative Example 5

This example is similar to Example 4, but an untreated aluminum sheet was employed as the support (no graining or anodizing).

Test

Samples were assessed as in Example 1.

Result

After use, the printing plate was found to have unacceptable coating adhesion failure. Areas of the image layers were flaking off the aluminum support, especially at the plate edges and where the plate had been clamped into the printing press.

Comparative Example 6

In this example, the key ingredients are rearranged so that the nitrocellulose is admixed with the IR-absorbing dye and remains in intimate contact with it. The aluminum substrate and silicone layers were as in Example 1.

Image Layer 104:

| Components | Parts by Weight Comparative Example 6 |
|---|---|
| Micropigmo AMBK-8 | 55.55 |
| Dowanol PM | 44.45 |

Image Layer 106:

| Components | Parts by Weight Comparative Example 6 |
|---|---|
| Cymel 303 Resin | 8.21 |
| Few Dye S 0094 | 3.44 |
| Walsroder E 400 NC | 4.07 |
| Lubrizol 2062 | 0.08 |
| Cycat 4040 | 1.64 |
| BYK 307 | 0.20 |
| nMP | 30.50 |
| Dowanol PM | 51.86 |

Test

Samples were assessed as in Example 1.

Result

After 200 paper sheets were printed, the 2% dots were fully formed at 141 mJ/cm$^2$. The plate shows problematical red spots spread across its surface, however. These plate areas fail to image, and on press, after cleaning, the plate produces unwanted voids on printed paper sheets (where silicone is undesirably retained).

Example 7

In this example, the same substrate, image layer 106 and silicone layer is used as in Example 2, but a different formulation for image layer 104 is used.

Image Layer 104:

| Components | Parts by Weight Example 7 |
|---|---|
| Cymel 300 Resin | 2.00 |
| Lubrizol 2062 | 0.05 |
| Cycat 4040 | 0.65 |
| BYK 307 | 0.07 |
| Black NC 60K330 | 4.45 |
| Dowanol PM | 92.78 |

Test

Samples were assessed as in Example 1.

Result

After 200 paper sheets were printed, the 1-pixel patch was fully solid at 159 mJ/cm$^2$, and the 2% dots well defined also. No red spots were found on the sample. The plate exhibited good color contrast.

| | L | a | b |
|---|---|---|---|
| Non-image area | 8.62 | −6.35 | 7.00 |
| Imaged area | 20.72 | 1.31 | 7.04 |
| Difference | 12.10 | 7.66 | 0.04 |

Example 8

In this example, the same substrate, image layer 104 and silicone layer is used as in Example 1, but a different formulation for image layer 106 is employed.

Image Layer 106:

| Components | Parts by Weight Example 8 |
|---|---|
| Cymel 300 Resin | 3.20 |
| IRT | 4.50 |
| Lubrizol 2062 | 0.08 |
| Cycat 4040 | 1.00 |
| BYK 307 | 0.07 |
| nMP | 30.50 |
| Dowanol PM | 60.65 |

IRT dye is an IR photosensitive bleaching dye as supplied by Showa Denko, Japan.

Test

Samples were assessed as in Example 1.

Result

After 200 paper sheets were printed, the 1-pixel patch was fully solid at 159 mJ/cm$^2$, the 2% dots well presented at 106 mJ/cm$^2$, and the 1% dots fully formed at 159 mJ/cm$^2$. No red spots were found on inspection of the plate sample. Plate color contrast was deemed average only.

| | L | a | b |
|---|---|---|---|
| Non-image area | 17.32 | −17.74 | −25.77 |
| Imaged area | 30.11 | −17.95 | −14.17 |
| Difference | 12.79 | 0.21 | 11.60 |

Comparative Example 9

This example illustrates the use of all key ingredients in one imaging layer. The aluminum substrate and silicone layers were as in Example 1.

The formulation given in the table below was used for the single imaging layer.

| Components | Parts by Weight Comparative Example 9 |
|---|---|
| Cymel 303 Resin | 8.21 |
| Few Dye S 0094 | 3.44 |
| Micropigmo AMBK-8 | 0.21 |
| Walsroder E 400 NC | 4.07 |
| Lubrizol 2062 | 0.08 |
| Cycat 4040 | 1.64 |
| BYK 307 | 0.20 |
| nMP | 30.50 |
| Dowanol PM | 51.65 |

Test

Samples were assessed as in Example 1.

Result

After 200 paper sheets were printed, the 2% dots were fully formed at 141 mJ/cm$^2$. The plate shows problematical red spots spread across its surface, however.

Although the present invention has been described with reference to specific details, it is not intended that such details should be regarded as limitations upon the scope of the invention, except as and to the extent that they are included in the accompanying claims.

What is claimed is:

1. A method of imaging a printing member, the method comprising the steps of:

(a) providing a printing member comprising (i) a substrate having an oleophilic surface;

(ii) first and second imaging layers disposed over the substrate, the first imaging layer comprising a binder and a near-IR absorber including a dye, the second imaging layer comprising a polymer and a near-IR absorber that does not include a dye; and (iii) disposed over the imaging layers, an oleophobic third layer;

(b) exposing the printing member to imaging radiation in an imagewise pattern, the imaging radiation at least partially ablating the imaging layers where exposed; and (c) cleaning the printing member to remove the third layer and at least a portion of the imaging layers where the printing member received imaging radiation, thereby creating an imagewise pattern on the printing member.

2. The method of claim 1, wherein (i) the first imaging layer has a first side in contact with the third layer and a second side, opposed to the first side, in contact with the second imaging layer, and (ii) the second imaging layer has a first side in contact with the first imaging layer and a second side, opposed to the first side, in contact with the substrate.

3. The method of claim 1, wherein the substrate is a metal sheet having a surface in contact with one of the imaging layers.

4. The method of claim 3, wherein the metal is aluminum.

5. The method of claim 1, wherein the binder of the first imaging layer is a melamine resin.

6. The method of claim 1, wherein the second imaging layer further comprises a resole resin.

7. The method of claim 1, wherein the second imaging layer comprises a melamine resin.

8. The method of claim 1, wherein the near-IR absorber of the first imaging layer further comprises carbon black.

9. The method of claim 1, wherein the near-IR absorber of the first imaging layer consists of a dye.

10. The method of claim 9, wherein the near-IR absorber of the second imaging layer consists of carbon black.

11. The method of claim 1, wherein a loading level of the near-IR absorber of the second imaging layer is no greater than 25%.

12. A lithographic printing member comprising:

(a) a substrate having an oleophilic surface;

(b) first and second imaging layers disposed over the substrate, wherein (i) the first imaging layer comprises a binder and a near-IR absorber including a dye, (ii) the second imaging layer comprises a polymer and a near-IR absorber that does not include a dye, and (iii) the first and second imaging layers are at least partially ablatable by exposure to near-IR radiation at a fluence level no greater than 210 mJ/cm$^2$; and (c) disposed over the imaging layers, an oleophobic third layer.

13. The printing member of claim 12, wherein (i) the first imaging layer has a first side in contact with the third layer and a second side, opposed to the first side, in contact with the second imaging layer, and (ii) the second imaging layer has a first side in contact with the first imaging layer and a second side, opposed to the first side, in contact with the substrate.

14. The printing member of claim 12, wherein the substrate is a metal sheet having a surface in contact with one of the imaging layers.

15. The printing member of claim 14, wherein the metal is aluminum.

16. The printing member of claim 12, wherein the binder of the first imaging layer is a melamine resin.

17. The printing member of claim 12, wherein the second imaging layer further comprises a resole resin.

18. The printing member of claim 12, wherein the second imaging layer comprises a melamine resin.

19. The printing member of claim 12, wherein the near-IR absorber of the first imaging layer further comprises carbon black.

20. The printing member of claim 12, wherein the near-IR absorber of the first imaging layer consists of a dye.

21. The printing member of claim 20, wherein the near-IR absorber of the second imaging layer consists of carbon black.

22. The printing member of claim 12, wherein a loading level of the near-IR absorber of the second imaging layer is no greater than 25%.

23. The printing member of claim 12, wherein the first and second imaging layers are at least partially ablatable by exposure to near-IR radiation at a fluence level no greater than 150 $mJ/cm^2$.

* * * * *